US007043040B2

(12) United States Patent
Westerkull

(10) Patent No.: US 7,043,040 B2
(45) Date of Patent: May 9, 2006

(54) HEARING AID APPARATUS

(75) Inventor: Patrick Westerkull, Hovås (SE)

(73) Assignee: P&B Research AB, Göteborg (SE)

( * ) Notice: Subject to any disclaimer, the term of this patent is extended or adjusted under 35 U.S.C. 154(b) by 0 days.

(21) Appl. No.: 10/481,587

(22) PCT Filed: Jun. 6, 2002

(86) PCT No.: PCT/SE02/01089

§ 371 (c)(1),
(2), (4) Date: Jul. 13, 2004

(87) PCT Pub. No.: WO03/001846

PCT Pub. Date: Jan. 3, 2003

(65) Prior Publication Data

US 2004/0234091 A1 Nov. 25, 2004

(30) Foreign Application Priority Data

Jun. 21, 2001 (SE) ..... 0102208

(51) Int. Cl.
*H04H 7/00* (2006.01)

(52) U.S. Cl. ..... 381/326; 455/3.06; 455/414.1; 607/57; 381/181; 381/380

(58) Field of Classification Search ..... 455/414.1, 455/414.4, 425, 3.05, 3.06, 66.1, 67.13, 573, 455/95, 334, 351; 600/25; 181/126, 127; 381/68, 69.2; 607/55, 57
See application file for complete search history.

(56) References Cited

U.S. PATENT DOCUMENTS

| | | | | |
|---|---|---|---|---|
| 3,809,829 | A | 5/1974 | Vignini et al. | |
| 4,498,461 | A | 2/1985 | Hakansson | |
| 4,776,322 | A * | 10/1988 | Hough et al. | 381/326 |
| 5,015,225 | A * | 5/1991 | Hough et al. | 600/25 |
| 5,323,468 | A | 6/1994 | Bottesch | |
| 5,456,654 | A * | 10/1995 | Ball | 600/25 |
| 5,554,096 | A * | 9/1996 | Ball | 600/25 |
| 5,800,475 | A | 9/1998 | Jules | |
| 5,913,815 | A | 6/1999 | Ball et al. | |
| 6,516,228 | B1 * | 2/2003 | Berrang et al. | 607/57 |
| 6,697,674 | B1 * | 2/2004 | Leysieffer | 607/57 |
| 2001/0031996 | A1 * | 10/2001 | Leysieffer | 607/57 |

FOREIGN PATENT DOCUMENTS

WO WO 9112783 A1 9/1991

* cited by examiner

*Primary Examiner*—Edward F. Urban
*Assistant Examiner*—Thuan Nguyen
(74) *Attorney, Agent, or Firm*—Venable LLP; Eric J. Franklin

(57) ABSTRACT

A hearing aid apparatus is intended for sound transmission from one side of the head to the cochlea on the other side of the head for rehabilitation of patients with unilateral hearing loss. The hearing aid apparatus is based on the bone conducting principle for bone anchored hearing aids and includes a vibratory generating part that is mechanically anchored by means of osseointegration in the skull bone at the deaf side of the patient and arranged to transmit vibrations through the skull bone from the deaf side to the inner ear on the other side of the patient. The frequency characteristics of the apparatus are preferably adapted in such a way that the amplification is higher for frequencies above 1 kHz than for lower frequencies, which is in contrast to an ordinary bone anchored hearing aid.

13 Claims, 2 Drawing Sheets

HEARING AID APPARATUS

FIELD OF THE INVENTION

The present invention relates to a hearing aid apparatus of the type which is intended for sound transmission from one side of the head to the cochlea on the other side of the head for rehabilitation of patients with unilateral hearing loss, i.e. individuals with a normal or a slightly impaired hearing on one ear and a profound hearing loss in the inner ear on the other side of the head.

BACKGROUND OF THE INVENTION

For the rehabilitation of these patients with single sided deafness traditional CROS (Contralateral Routing Of Signal) hearing aids are used today. Such a hearing aid comprises a microphone on the deaf side of the patient and an amplifier with a loudspeaker on the good ear. The sound is then transmitted from the deaf side to the good ear to avoid the head shadow effect which otherwise makes it difficult for a patient to hear anything from the deaf side of the head. One example of this type of hearing aid is described in U.S. Pat. No. 3,809,829.

Another example of a previously known CROS device comprises a powerful traditional hearing aid placed on the deaf ear. In this case, the sound is amplified by the apparatus and picked up in the ear canal and converted into vibrations in the skull bone. The vibrations are then transmitted to the cochlea of the good ear. This type of apparatus is usually named transcranial CROS.

Unfortunately these types of hearing aids for rehabilitation of patients with single sided deafness have significant drawbacks. In the first-mentioned apparatus the hearing in the good ear is reduced, due to the apparatus itself in the ear but also due to the fact that the signal must be transmitted from the microphone on the deaf side to the other side by means of a cable or for instance by means of a FM radio link. A transcranial CROS, on the other side, involves acoustic feed-back problems unless the ear plug is made very tight. Another disadvantage with transcranial CROS devices is the fact that the sound quality is poor in these devices as they often has to be working with full power.

For persons with other types of impaired hearing, for instance a misfunction in the auditory canal or a chronic ear inflammation, there are bone conducting hearing aids on the market today, i.e. bone anchored hearing aids which mechanically transmit the sound information to a person's inner ear via the skull bone. Such a hearing aid is described for instance in U.S. Pat. No. 4,498,461.

In such a bone anchored hearing aid the sound information is mechanically transmitted by means of a vibrator via the skull bone to the inner ear of a patient. The hearing aid device is connected to an implanted titanium screw installed in the bone behind the poor, external ear and the sound is transmitted via the skull bone to the cochlea (inner ear) of this poor ear, i.e. the hearing aid works irrespective of a disease in the middle ear or not. The bone anchoring principle means that the skin is penetrated which makes the vibratory transmission very efficient.

This type of hearing aid device has been a revolution for the rehabilitation of patients with certain other types of impaired hearing. It is very convenient for the patient and almost invisible with normal hair styles. It can easily be connected to the implanted titanium fixture by means of a bayonet coupling or a snap in coupling.

However, these hearing aid devices have substantially been designed for stimulating the inner ear on the same side of the skull where the apparatus is placed, and they have so far not been used for rehabilitation of those patients mentioned above, i.e. patients with single sided deafness. It is an object of the present invention to provide a hearing aid for rehabilitation of the patient category that has been described here, but which hearing aid in contrast to the above-mentioned so-called CROS and BICROS devices is based on the bone conducting principle, i.e. a bone anchored hearing aid in which the vibratory device is mechanically anchored in the skull bone by means of osseointegration.

SUMMARY OF THE INVENTION

According to the invention the bone conducting hearing aid is arranged to be installed outside or partially implanted in the skull bone at the deaf side of the patient with the vibratory generating part of the hearing aid mechanically anchored in the skull bone by means of osseointegration and arranged to transmit vibrations through the skull bone from the deaf side to the inner ear on the other side of the patient.

According to a preferred embodiment of the invention the frequency characteristic is specifically adapted to transmit vibrations in the skull bone from one side of the skull to the other.

BRIEF DESCRIPTION OF THE DRAWINGS

In the following the invention will be described more in detail with reference to the accompanying drawings in which.

DETAILED DESCRIPTION OF EMBODIMENTS OF THE INVENTION

Figure 1:
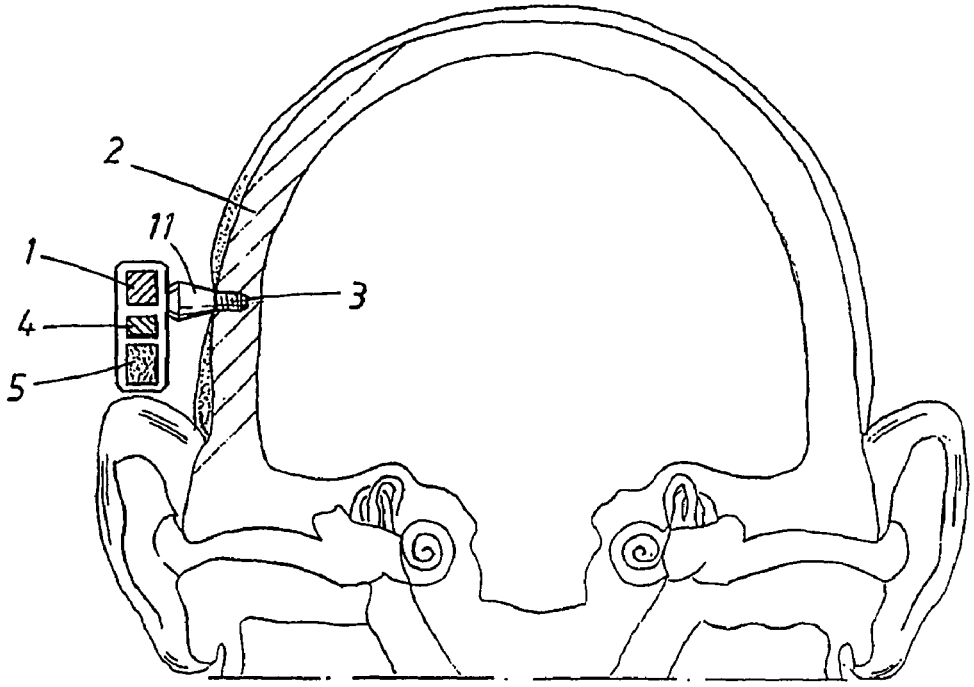
FIG. 1 illustrates the principles for the hearing aid.

FIG. 1 shows schematically the skull of a patient with the auditory organs in the form of an external ear, auditory meatus, middle ear and inner ear. The patient has a profound hearing loss in the inner ear on one side but normal or only a slightly impaired hearing on the other side. On the deaf side there is a hearing aid anchored in the skull bone, preferably in the mastoid bone behind the external ear. The hearing aid comprises a housing with a vibrator 1 which via a skin penetrating spacer 11 is mechanically anchored in the skull bone 2 by means of a fixture 3. The sound is picked up by the hearing aid by means of a microphone 5 and is then amplified and filtered in an electronic circuitry 4.

As it is mainly the high frequencies which are attenuated at the bone conduction from one side of the skull to the other, the frequency characteristics of the hearing aid is preferably adapted for this application which means that the amplification is higher in the treble, frequencies above 1 kHz, than in the bass, which is in contrast then to an ordinary bone anchored hearing aid.

As the vibrations from the vibrator 1 in this case must be transmitted from one side of the skull to the other it is, due to specific resonance and attenuation characteristics in the skull, an advantage if the electronic circuitry 4 comprises means for converting the signal from the microphone 5 from an analog to a digital signal for the necessary signal processing. Such signal processing means can then be used for adapting for instance the frequency characteristics to individual differences in the head shadow effect, the sound environment, the skull resonance, sound direction and the hearing capacity of the well-functioning ear. The signal processing means can also be used for actively counteracting acoustic feed-back problems.

Figure 2:
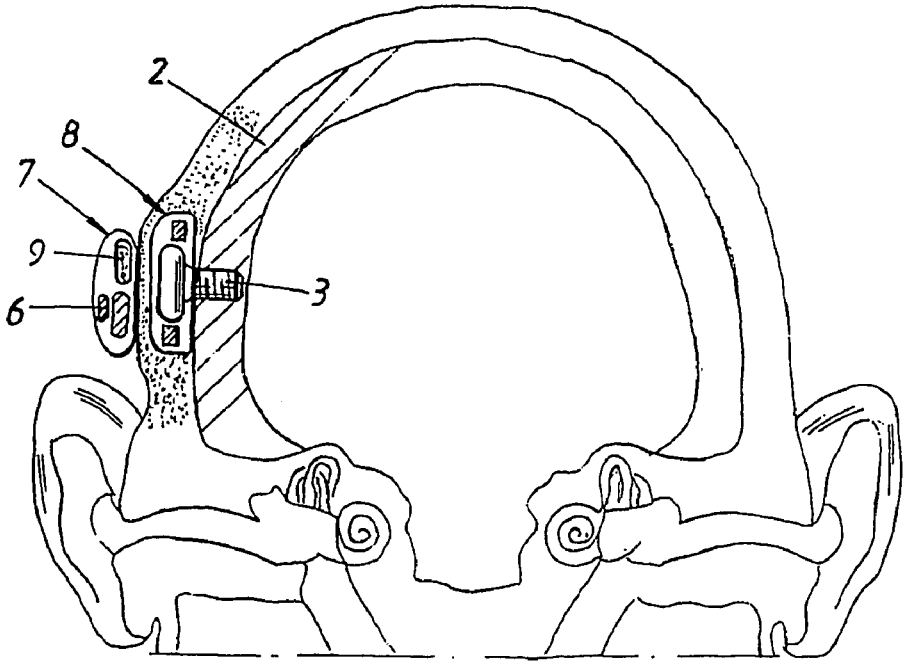
FIG. 2 illustrates an alternative embodiment of the invention in which the hearing aid is partially implanted.

In order to avoid skin penetration the hearing aid can be made with an implantable part including the vibrator and an external part including the microphone 6, see FIG. 2. The external part 7 then also comprises a battery 9 and the power is transmitted to the implanted part 8 of the hearing aid by means of induction.

Figure 3:
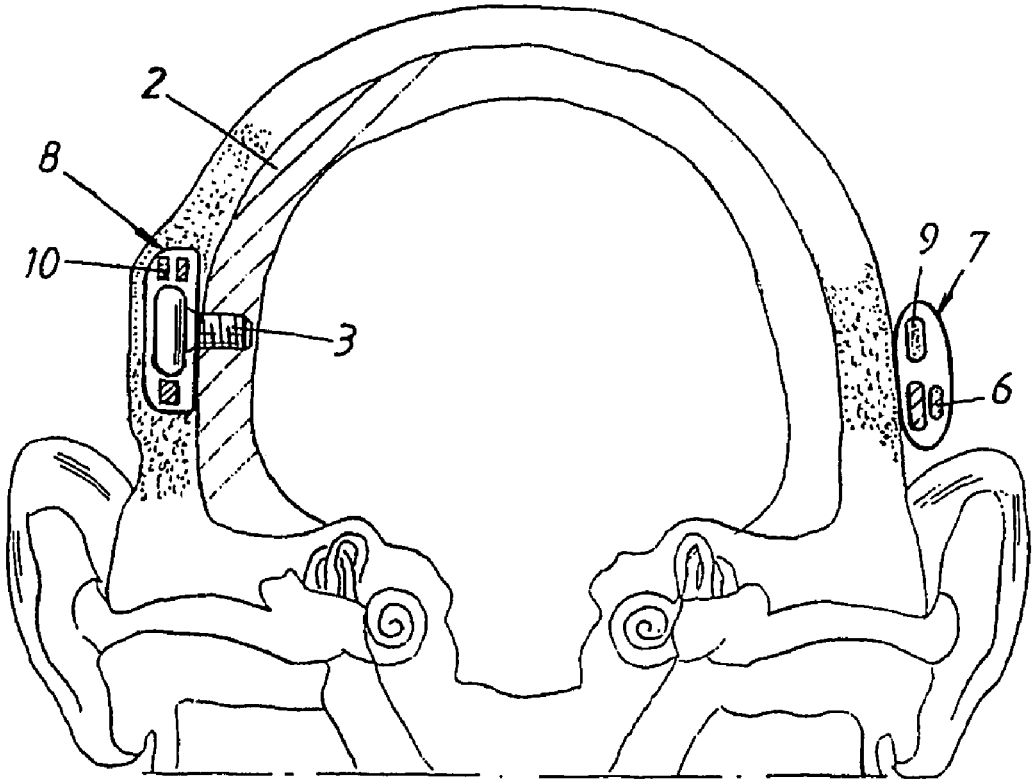
FIG. 3 illustrates an alternative solution with a partially implanted hearing aid in which the implantable part is arranged on the good (non deaf) side of the skull, while the external part of the hearing aid is placed on the deaf side.

In FIG. 3 it is illustrated an alternative embodiment of the hearing aid in which the implanted part also comprises a rechargeable battery 10 which is charged by means of induction from an external power supply. In this case the implanted part 8 is arranged on the non-deaf side of the skull, while the external part 7 with the microphone 6 and the battery 9 also in this case are located on the deaf side of the skull. The transmission of the signal from the external part 7 to the implanted part 8 can be effectuated by means of an analog or a digital radio signal.

The invention is not limited to the examples described here but can be varied within the scope of the accompanying claims.

What is claimed is:

1. A bone-conducting bone-anchored hearing aid apparatus for sound transmission from one side of a patient's head to the patient's cochlea on another side of the patient's head for rehabilitation of unilateral hearing loss, the hearing aid apparatus comprising:

a vibratory generating part arranged to generate vibrations that are mechanically transmitted through the skull bone from a deaf side to the inner ear on the other side of the patient; and an implantable part operative to mechanically anchor the vibratory generating part, the implantable part being osseointegrated in the patient's skull bone behind an external ear at the deaf side of a patient.

2. The hearing aid apparatus according to claim 1, wherein the implantable part comprises an implant screw.

3. The hearing aid apparatus according to claim 1, wherein the frequency characteristics of the apparatus are specifically adapted to transmit vibrations in the skull bone from one side of the skull to the other side.

4. The hearing aid apparatus according to claim 3, wherein the hearing aid apparatus amplifies treble frequencies more than base frequencies.

5. The hearing aid apparatus according to claim 4, wherein the treble frequencies have a frequency greater than 1 kHz.

6. The hearing aid apparatus according to claim 1, further comprising:

electronic circuitry operative to convert a signal from a microphone of the hearing aid to the vibratory generating part from an analog signal to a digital signal.

7. The hearing aid apparatus according to claim 6, wherein the electronic circuitry comprises digital signal processing means.

8. The hearing aid apparatus according to claim 7, wherein the signal processing means adapts frequency characteristics to individual differences in an acoustic head shadow effect, to a sound environment, to a resonance of the patient's skull, or to a hearing capacity of a functioning ear of the patient.

9. The hearing aid apparatus according to claim 6, wherein the electronic circuitry comprises signal processing means for actively counteracting acoustic feed-back problems in the apparatus.

10. The hearing aid apparatus according to claim 6, further comprising:

directivity means comprising at least one directivity dependent microphone and/or signal processing means in the electronic circuitry.

11. The hearing aid apparatus according to claim 1, wherein the implantable part and the vibratory generating part comprise an internal part, the hearing aid apparatus further comprising:

an external part comprising a microphone and a battery, wherein power to the internal part is transmitted from the external part by induction.

12. The hearing aid apparatus according to claim 11, wherein the internal part comprises a rechargeable battery arranged to be charged by induction from an external power supply.

13. A method of rehabilitating a patient with unilateral hearing loss, the method comprising:

anchoring an implantable part in a skull bone behind an external ear at the deaf side of the patient, such that the implantable part is osseointegrated in the skull bone; and interconnecting with the implantable part a vibratory generating part arranged to generate vibrations which are mechanically transmitted through the skull bone from a deaf side to the inner ear on the other side of the patient, the implantable part mechanically anchoring the vibratory generating part, wherein the implantable part and the vibratory generating part comprise parts of a bone-conducting hearing aid apparatus.

* * * * *